US006946961B2

(12) United States Patent
Frederiksen et al.

(10) Patent No.: US 6,946,961 B2
(45) Date of Patent: Sep. 20, 2005

(54) SECURITY SYSTEM WITH MECHANISM FOR CONTROLLING CORD TWISTING

(75) Inventors: Bjarne Frederiksen, Lombard, IL (US); Terrance Surma, Bloomingdale, IL (US); Roger Leyden, Willow Springs, IL (US)

(73) Assignee: Se-Kure Controls, Franklin Park, IL (US)

( * ) Notice: Subject to any disclaimer, the term of this patent is extended or adjusted under 35 U.S.C. 154(b) by 3 days.

(21) Appl. No.: 10/642,953

(22) Filed: Aug. 18, 2003

(65) Prior Publication Data

US 2005/0040949 A1 Feb. 24, 2005

(51) Int. Cl.[7] ..... G08B 13/14

(52) U.S. Cl. ..... 340/568.2; 340/568.1; 340/568.3; 340/548; 340/571

(58) Field of Search ..... 340/568.1, 568.2, 340/568.3, 548.3, 665, 691.3, 691.6, 693.5, 693.9, 687, 571, 548, 568.4, 691

(56) References Cited

U.S. PATENT DOCUMENTS 5,124,685 A * 6/1992 Rankin ..... 340/568.2
D335,439 S 5/1993 Leyden et al.
5,246,183 A 9/1993 Leyden
5,279,135 A 1/1994 Leyden et al.
5,341,124 A 8/1994 Leyden et al.
5,467,075 A * 11/1995 Rand ..... 340/568.4
5,861,807 A * 1/1999 Leyden et al. ..... 340/568.2
6,155,617 A * 12/2000 Kuenzel ..... 292/318
RE37,590 E 3/2002 Leyden et al.
6,476,717 B1 * 11/2002 Gross et al. ..... 340/568.1
6,659,382 B2 * 12/2003 Ryczek ..... 242/379

* cited by examiner

*Primary Examiner*—Hung Nguyen
(74) *Attorney, Agent, or Firm*—Wood, Phillips, Katz, Clark & Mortimer

(57) ABSTRACT

A security system having a flexible cord with a length, a housing, and a connector on the cable. The housing is mountable in an operative position on the support. The cord is urged into a stored state into the housing and can be selectively withdrawn therefrom. The connector is attachable to an article to be monitored. At least one of a) a first discrete part of the cord is repositionable relative to a second discrete part of the cord and b) at least a part of the housing is repositionable relative to a support on which the housing is mounted in an operative position to control twisting of the cord about the length of the cord by reason of turning of the connector.

29 Claims, 6 Drawing Sheets

Fig 8
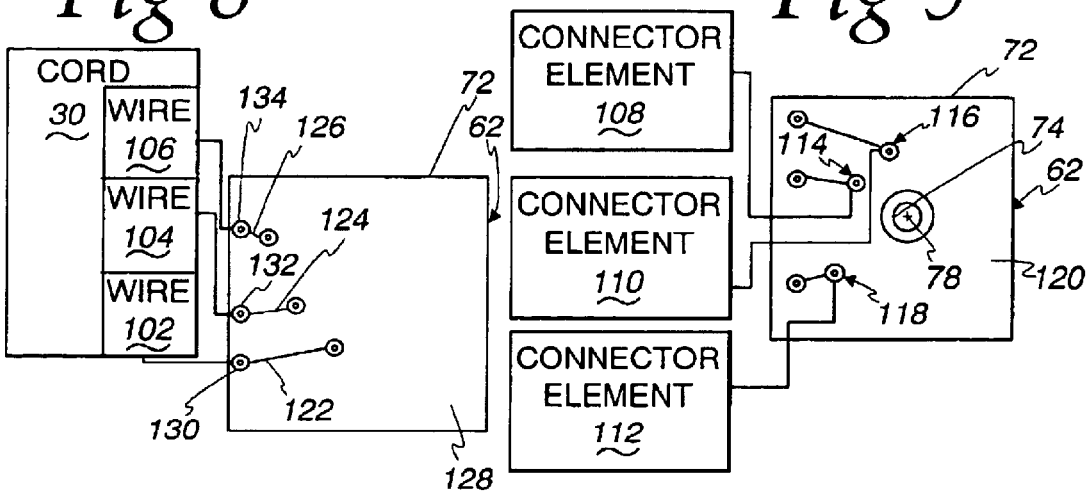
Fig 9
Fig 10
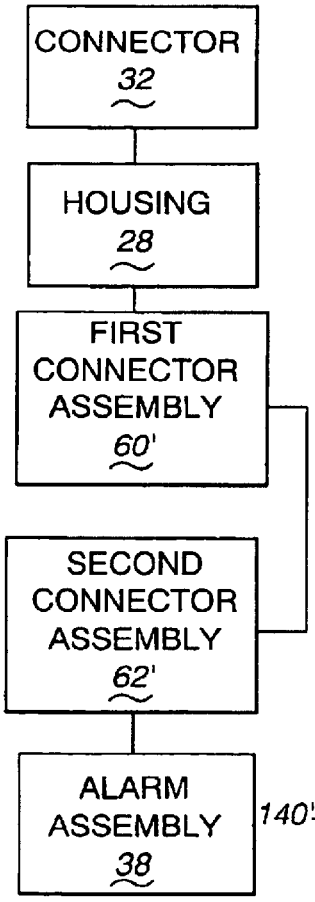
Fig 11
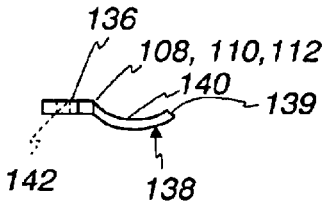
Fig 12
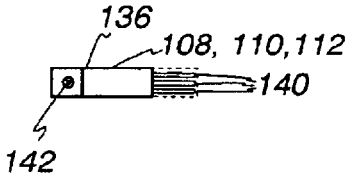
Fig 13
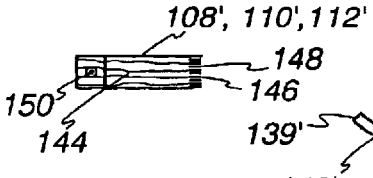
Fig 14
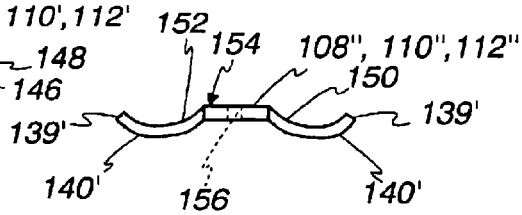
Fig 15
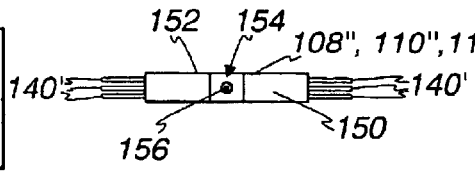
Fig 16
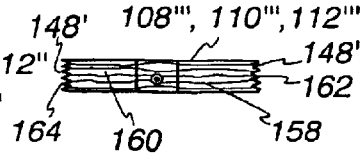

SECURITY SYSTEM WITH MECHANISM FOR CONTROLLING CORD TWISTING

BACKGROUND OF THE INVENTION

1. Field of the Invention

This invention relates to security systems for discrete articles and, more particularly, to a system which incorporates a mechanism to control twisting of a cord about its length as articles, to which the cord is attached, are repositioned.

2. Background Art

In many stores, point of purchase displays are provided to allow articles to be picked up and operated by a potential consumer. This display style is particularly desirable in the electronics industry. Myriad electronic components are currently available, ranging from those that are purely for entertainment, such as music players, to those that are purely functional, such as hand tools. New developments in the electronics field commonly tend towards miniaturization and increased electronic sophistication. As the electronics industry continues to evolve, new products are constantly being introduced with ever increasing capabilities and quality. As just examples, music players and video recorders continue to become smaller, while at the same time their quality is being improved. Personal digital assistants (PDA's) are being offered with more and more features, yet are being downsized for convenience of operation and transportation.

Since sales of consumer electronics often hinge upon the compatibility of potential consumers' requirements or desires with the capabilities of a particular article, it becomes increasingly important for the consumers to experience the particular article in a "hands on" environment prior to purchase. Displays in high volume electronic stores routinely make electronic merchandise readily available to be operated by a potential consumer. While this display style is advantageous for the consumer, it also offers a temptation to thieves. Losses due to theft in the consumer electronics industry continue to skyrocket.

To thwart thievery, while at the same time accommodating a potential consumer's desire to operate small electronic articles, a wide range of security systems have been developed. One commonly used system employs a flexible cord which is biasably retractable into a housing and selectively extendable therefrom. The cord typically has an end connector which is attached to an article that is being monitored. These systems range from ones that are purely mechanical, as disclosed in U.S. Pat. No. 5,246,183, to those that are electronically operated, as shown in U.S. Pat. No. Re. 37,590E.

These types of systems lend themselves to being set up in different manners at displays. In one conventional display arrangement, the cord storing housing is mounted at one side of a shelf or wall and projects therethrough to be engaged with an article to be secured on the other side of the shelf/wall. The article is inspected by being grasped by the potential consumer. By exerting a force on the article, the cord is selectively drawn out against a spring force to an extent determined by the length of the cord. By releasing the force on the article, the article is drawn through the retracting cord to against a surface on either the shelf, the wall, or the housing.

One problem that has arisen with this type of system is that the cord tends to be twisted as the article associated therewith is handled by a potential consumer. A potential consumer, through operation of the article, may pivot the article so as to impart a twist to the cord about its length. The imparted twist may remain as the article is returned to a stored state and biased against the wall, shelf, or housing. A repeated twisting motion on the cord may produce a cumulative twist that eventually causes the cord to kink. This may undesirably reduce the effective length of the cord and, in a worst case, impair or prevent retraction of the cord into the housing. When this condition occurs, a potential consumer may just place the article upon the shelf, or allow the same to dangle from a wall in a manner that causes the display to become unsightly. Thus, this condition potentially defeats the function of the retracting mechanism and contributes to an unsightly display. To remedy this situation, the store owner may be required to have someone access the housing to untangle the cord. In some system setups, this may necessitate disassembling components in the vicinity of the housing.

The industry continues to seek out solutions that afford the functional advantages of a retractable cord, without the inherent cord twisting problems.

SUMMARY OF THE INVENTION

In one form, the invention is directed to a security system having a flexible cord with a length, a housing, and a connector on the cable. The housing is mountable in an operative position on the support. The cord is urged into a stored state into the housing and can be selectively withdrawn therefrom. The connector is attachable to an article to be monitored. At least one of a) a first discrete part of the cord is repositionable relative to a second discrete part of the cord and b) at least a part of the housing is repositionable relative to a support on which the housing is mounted in an operative position to control twisting of the cord about the length of the cord by reason of turning of the connector.

In one form, the first discrete part of the cord has a first connector assembly and a second discrete part of the cord has a second connector assembly. At least a part of the first connector assembly is movable guidingly relatively to at least a part of the second connector assembly.

In one form, the cord has at least a first conductive element. The first connector assembly has a first connector element and the second connector assembly has a second connector element. The first and second connector assemblies define a conductive path for the at least first conductive element between the first and second discrete cord parts.

In one form, the first connector element is movable guidingly relative to the second connector element around an axis.

In one form, the first connector element is movable against the second connector element as the at least part of the first connector assembly is moved guidingly relative to the at least part of the second connector assembly.

In one form, the first connector element includes an arcuate conductor, with the second connector element including a first conductive arm which contacts the arcuate conductor.

In one form, the first conductive arm has a plurality of discrete fingers which contact the arcuate conductor.

The second connector element may include a second arm which contacts the arcuate conductor. The first and second arms contact the arcuate conductor at spaced locations.

The security system may further include an alarm assembly capable of generating a detectable signal in the event that the conductive path is interrupted.

The security system may further include an article to which the connector is attached.

In one form, the connector has an armed state when attached to an article to be monitored and an alarm state with the connector detached from an article to be monitored. The alarm system generates the detectable signal as an incident of the connector being detached and changing from the armed state into the alarm state.

The system may further be provided in combination with a support to which the housing is mounted in the operative position.

In one form, the support has an associated layer with first and second opposite sides. The housing is on the first side of the layer, with the cord extending through the layer so that the connector is at the second side of the layer.

In one form, the security system includes a bearing assembly which acts between the housing and the support to guide repositioning of the housing relative to the support.

In one form, the bearing assembly has a first bearing portion that moves as one piece with the housing and a second bearing portion on the support. A plurality of bearing elements act between the first and second bearing portions.

In one form, the bearing elements are roller elements, that may be in the shape of spheres.

The security system may further include a support bracket to which the housing is mounted so that the support bracket moves as one piece with the housing.

In one form, the first connector element is movable guidingly relative to the second connector element continuously in one direction around the axis without causing kinking of the cord.

The invention is further directed to a security system including a flexible cord having a length, a housing, a support to which the housing is mounted in an operative position, and an article to which the cord is attached. The cord is urged into the housing into a stored state and can be selectively withdrawn therefrom. The flexible cord, housing, and support are interconnected so that the cord can be turned about its length continuously in one direction without causing kinking of the cord.

In one form, the flexible cord has first and second discrete parts and the first discrete part of the cord has a first connector assembly and the second discrete part of the cord has a second connector assembly. At least a part of the first connector assembly is movable guidingly relative to at least a part of the second connector assembly.

In one form, the cord has at least a first conductive element, the first connector assembly has a first connector element, and the second connector assembly has a second connector element. The first and second connector assemblies define a conductive path for the at least first conductive element between the first and second discrete cord parts.

In one form, the first connector element is movable guidingly relative to the second connector element around an axis.

The security system may further include an alarm assembly capable of generating a detectable signal in the event that the conductive path is interrupted.

The security system may further include a layer associated with the support and having first and second opposite sides. The housing is on the first side of the layer with the cord extending through the layer so that the connector is on the second side of the layer.

In one form, the security system includes a bearing assembly which acts between the housing and the support to guide repositioning of the housing relative to the support.

The bearing assembly may include a first bearing portion that moves as one piece with the housing and a second bearing portion on the support. A plurality of bearing elements act between the first and second bearing portions.

BRIEF DESCRIPTION OF THE DRAWINGS

FIG. 8 is a view corresponding to that in FIG. 6 and showing a second connector assembly, including a circuit board, which cooperates with the first connector assembly in FIGS. 6 and 7;

FIG. 9 is a view as in FIG. 8 taken from the side of the board opposite that in FIG. 8;

FIG. 10 is a schematic representation of one form of the security system generically representing different configurations for the first and second connector assemblies shown in FIGS. 6–9;

FIG. 11 is an elevation view of one form of connector element utilized on the connector assembly in FIGS. 8 and 9;

FIG. 12 is a plan view of the connector element in FIG. 11;

FIG. 13 is a view as in FIG. 12 of a modified form of connector element;

FIG. 14 is a view as in FIG. 11 of a further modified form of connector element;

FIG. 15 is a plan view of the connector element in FIG. 14;

FIG. 16 is a view corresponding to that in FIG. 15 of a further modified form of connector element;

DETAILED DESCRIPTION OF THE DRAWINGS

Figures 1, 2:
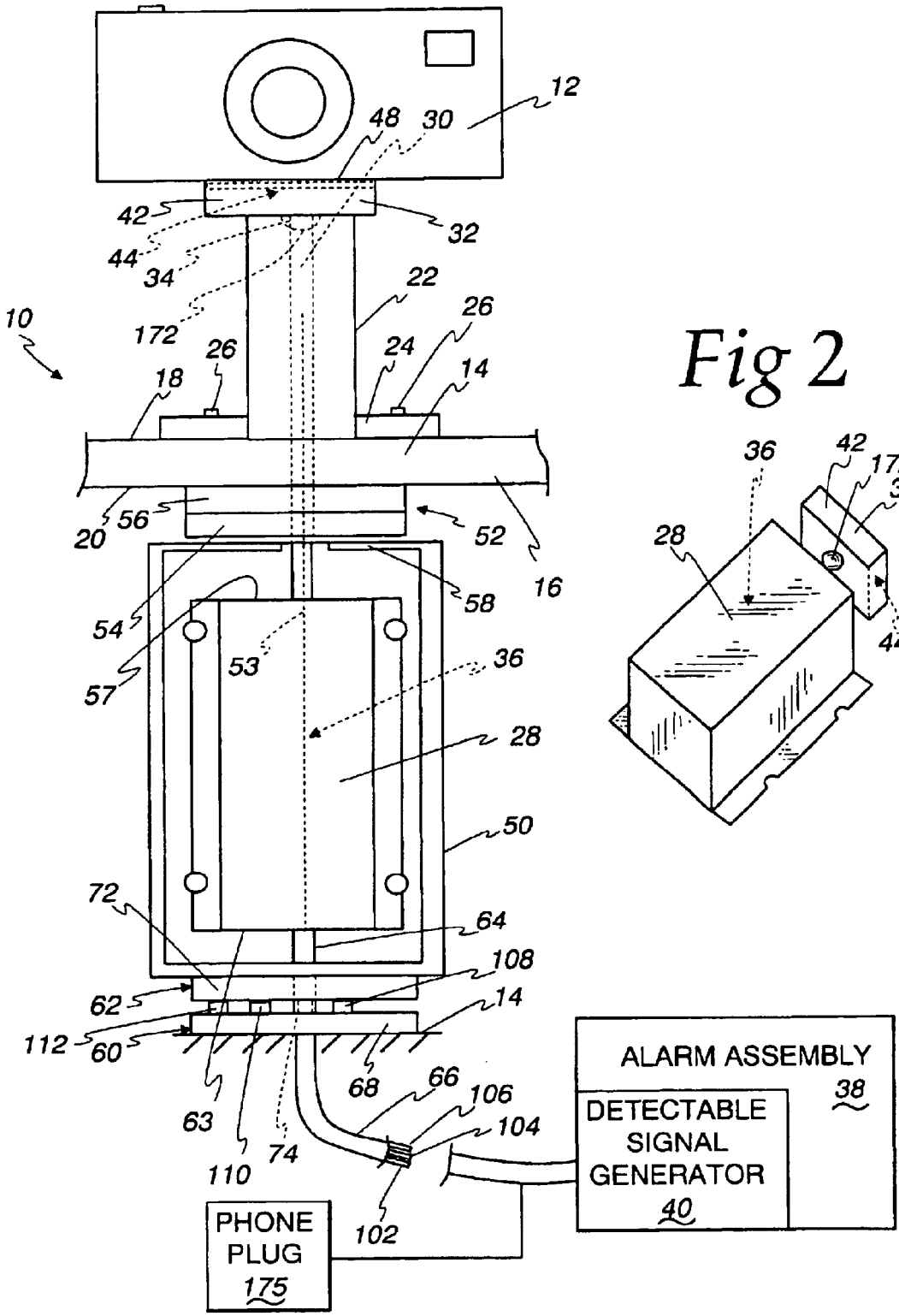
FIG. 1 is a fragmentary, elevation view of one form of security system, according to the present invention, and including a housing with a retractable, flexible, cord which is joined at one end to an article to be monitored through a connector, and at the other end to an alarm assembly including a detectable signal generator.
FIG. 2 is a perspective view of the housing and connector in FIG. 1, with the cord fully retracted.

Referring initially to FIGS. 1–9, one form of security system, according to the present invention, is shown at 10. The security system 10 is useable to secure and monitor an article. In this case, a representative article is shown as a camera 12. The nature of the particular article is not important as the inventive concept can be used to secure and monitor virtually any size, shape, or type of article.

The security system 10 is integral with a support 14, which likewise can take any of virtually a limitless number of different forms. In this case, the support 14 is shown as including a wall/layer 16 with opposite sides 18, 20. An optional tube 22 is mounted to the wall/layer 16 to maintain the article 12 in a display position spaced from the wall/layer 16 for convenience of access by a potential consumer. The tube 22 is integral with a flange 24 that is fixedly attached to the wall/layer 16 through screws 26, which may incorporate a security feature to prevent unauthorized removal.

Figure 4:
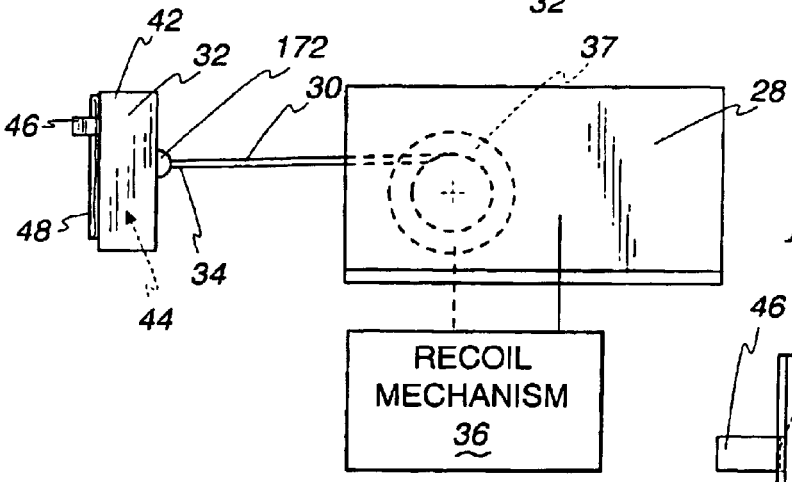
FIG. 4 corresponds to FIG. 3 with the cord extended.

The security system 10 further includes a housing 28 which contains a wrapped, flexible cord 30 having a length which dictates the extent to which the article 12 can be repositioned relative to the tube 22 and support 14. A connector 32 is attached at one free end 34 of the flexible cord 30. Through a recoil mechanism 36, the flexible cord 30 is biasably urged into a stored state in which it is wrapped around a bobbin core 37 (FIG. 4). The cord 30 can be selectively withdrawn from the housing 28 by exerting a force on the connector 32 sufficient to overcome the retracting force produced through the recoil mechanism 36 within the housing 28.

The flexible cord 30 extends from the connector 32 to the wrapped supply of the cord 30 within the housing 28 and continuously therefrom to outside of the housing 28 for connection to an alarm assembly 38. Through this arrangement, a continuous conductive path is established between the connector 32 and the alarm assembly 38. Any interruption of this conductive path is sensed by the alarm assembly 38, as an incident of which a detectable signal generator 40 on the alarm assembly 38 is caused to generate an audibly or visually detectable signal to alert an individual monitoring the security system 10 that there has been a breach.

In this embodiment for the security system 10, the housing 28, the recoil mechanism 36 and the flexible cord 30 are shown as an assembly which the assignee currently sells commercially under the registered trademarks RECOILER® and RETRACTOR®. Further details of this mechanism are disclosed in U.S. Pat. No. Re. 37,590E, which is incorporated herein by reference. While this particular mechanism is suitable for defining a conductive path between the connector 32 and alarm assembly 38 and biasably retracting the flexible cord 30 between these components, this particular mechanism is described only for exemplary purposes and should not be viewed as limiting. Virtually any type of mechanism, currently known to those skilled in the art, could be used to perform the above stated functions and to incorporate the same into the inventive security system 10, as hereinafter described.

Figure 3:
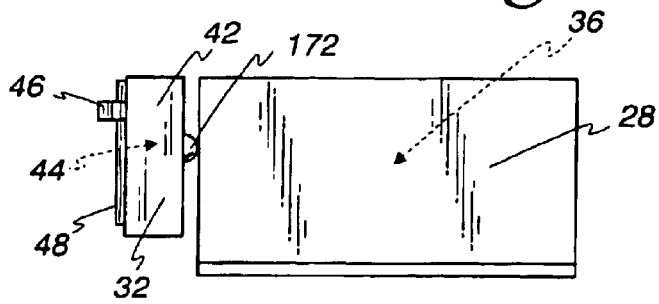
FIG. 3 is a side elevation view of the housing with the cord retracted as in FIG. 2.
Figure 5:
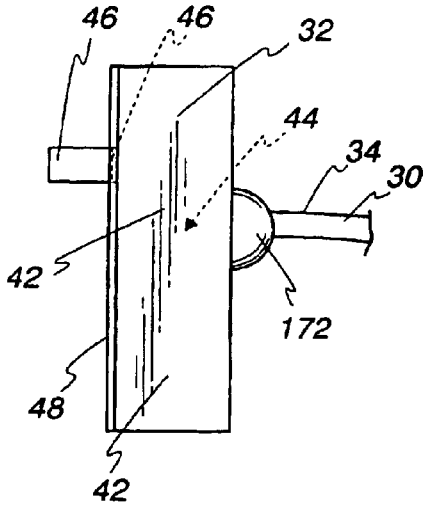
FIG. 5 is an enlarged, fragmentary, elevation view of the connector in FIGS. 1–4.
Figure 6:
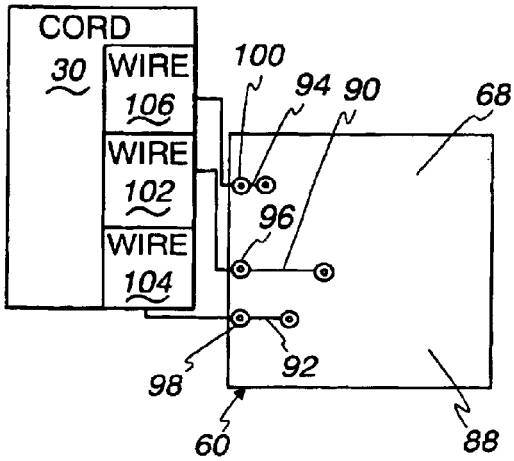
FIG. 6 is a partially schematic representation of a first connector assembly for establishing a conductive path between two discrete portions of the cord on the security system of FIG. 1, and including a circuit board.
Figure 7:
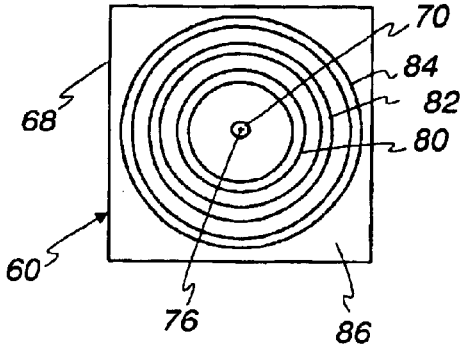
FIG. 7 is a view of the circuit board taken from the side opposite that in FIG. 6.

The connector 32 can likewise take any of virtually a limitless number of different forms. In the embodiment depicted, the connector 32 has a housing 42 which contains switching components 44. In this particular configuration, a spring-loaded pin 46 is operatively associated with the switching components 44. The pin 46 is normally spring biased to an extended position, as shown in FIGS. 3–5. The pin 46 can be depressed to the phantom line position in FIG. 5 to place the connector 32 and switching components 44 in an armed state.

In this embodiment, the connector 32 is attached to the article 12 through the use of a double-sided adhesive layer 48. With the connector 32 attached to the article 12, the pin 46 is pressed into the armed state, which state is maintained so long as the connector 32 remains attached to the article 12. In the event that the connector 32 is separated from the article 12, the pin 46 springs outward so as to place the connector 32 and switching components 44 in an alarm state, which causes the detectable signal generator 40 to generate an audible and/or visual electronic signal. The nature of this signal is again not important to the present invention. Exemplary details of a suitable alarm assembly 38 are shown in U.S. Pat. No. 5,341,124, which is incorporated herein by reference. That system is exemplary in nature and not intended to be limited, as many variations therefrom are contemplated according to the present invention.

The housing 28 is attached at the side 20 of the support 14. In this embodiment, the housing 28 is mounted to a bracket or arm 50, which in turn is mounted to the wall/layer 16 at the side 20 of the support 14. The bracket/arm 50 is mounted to the wall/layer 16 through a bearing assembly 52, which guides movement of the bracket/arm 50 and housing 42 relative to the wall/layer 16 about an axis 53. The bearing assembly 52 consists of a first bearing portion 54 that is connected to the bracket/arm 50. The bearing assembly 52 further includes a second bearing portion 56 on the wall/layer 16. Through this arrangement, the bracket/arm 50 is movable guidingly around the axis 53 relative to the wall/layer 16. The housing 28 is mounted to the bracket/arm 50 to move as one piece therewith and with the first bearing portion 54.

The portion of the cord 30, extending from one end 57 of the housing 28, extends through a wall 58 on the bracket/arm 50, the bearing assembly 52, the wall/layer 16, and the tube 22 to the connector 32 disposed outside, and on top, of the tube 22. With this arrangement, as the potential consumer grasps the article 12 and extends the flexible cord 30, any force imparted to the article 12, and the connector 32 thereon, tending to twist the cord 30 about its length, causes the bracket/arm 50 and housing 28 to pivot/rotate guidingly through the bearing assembly 52 about the axis 53. As a result, there is not an accumulation of twisting forces that might eventually cause the flexible cord 32 to distort, effectively shorten, bind within the housing 28, and ultimately kink. Instead, as a relatively modest twisting force is imparted to the flexible cord 30, this force is transmitted through the housing 28 to the bracket/arm 50 to thereby pivot/rotate the bracket/arm 50 through a range as dictated by the magnitude of the twisting force.

Cooperating first and second connector assemblies 60, 62 are provided to maintain a commutative electrical connection between a first discrete part 64 of the cord 30, projecting from the other end 63 of the housing 28 and connected to the second connecting assembly 62, and a second discrete cord part 66 connected to the connecting assembly 60 and extending to the alarm assembly 38, as the bracket/arm 50, bearing portion 54 and housing 20 pivot about the axis 53. In this embodiment, the first connector assembly 60 consists of a board 68 having a central post 70. The second connector assembly 62 is made from a similarly configured board 72 with a cylindrical receptacle 74 to receive the post 70. The post 70 and receptacle 74 cooperate to guide relative rotational movement between the boards 68, 72 about an axis that extends through their centers 76, 78, respectively. The centers 76, 78 align with the axis 53.

The first connector assembly 60 is shown to have three, arcuate, and preferably annular, concentric connector elements 80, 82, 84, defined by conductive plating on one side 86 of the board 68. Actually, six to eight such connector elements are normally provided in concentric relationship to permit the required electrical paths to be established for the alarm assembly 38 to operate wit the desired features. However, to simplify the structure, for illustration purposes only, three such connector elements 80, 82, 84 are shown and described herein. The opposite side 88 of the board 68 has conductive traces 90, 92, 94 connected conventionally through the board 68 to the connector elements 80, 82, 84, successively. The conductive traces 90, 92, 94 have connecting locations 96, 98, 100 at which conductive elements/wires 102, 104, 106 can be electrically connected. In this exemplary embodiment, the flexible cord 30 is shown with three conductive elements/wires 102, 104, 106 which are connected at the connecting locations 96, 98, 100. The conductive elements/wires 102, 104, 106 preferably correspond in number to the connector elements 80, 82, 84.

It should be understood that the particular circuitry that is integrated into the security system 10 is not critical to the present invention. Many different commutative means have been devised in the art to perform the basic functions described herein. It is expected that at least one wire will be incorporated into the system 10 to define a conductive path between the alarm assembly 38 and connector 32. It is likewise anticipated that one, or a plurality of, additional wires, potentially eight or more in number, would be utilized to make the necessary electrical connections to provide the function and features desired.

The second connector assembly 62 has a corresponding number of connector elements 108, 110, 112 which are operatively connected at locations 114, 116, 118 on one side 120 of the board 72 on the second connector assembly 62. Through conductive traces 122, 124, 126 on the opposite side 128 of the board 72, a conductive path is established through the board 72 between the connector elements 108, 110, 112 and connecting locations 130, 132, 134. The conductive elements/wires 102, 104, 106 are connected at the locations 130, 132, 134 in conventional fashion. With this arrangement, the connector assemblies 60, 62 define a conductive path for each of the conductive elements/wires 102, 104, 106 between the first and second discrete cord parts 64, 66.

The board 72 can be attached to the bracket/arm 50 so as to move as one piece therewith. The board 68 can be attached to the support 14 at a location spaced from the location on the support 14 at which the bearing assembly 52 is attached.

The described configuration of the bearing assembly 52 should not be viewed as limiting. The use of the flat boards 68, 72 potentially allows a relatively compact configuration for the overall system 10. However, as shown schematically in FIG. 10, the invention contemplates first and second cooperating connector assemblies 60', 62' having other, different configurations known to those skilled in the art, as shown generically in FIG. 10. For example, the first and second connector assemblies 60', 62' could be in the form of concentric, relatively rotatable elements, or axially stacked elements, as hereinafter described with respect to FIG. 27. Known cord detangling mechanisms could also be incorporated to achieve the ends described herein.

The connector elements 108, 110, 112 could also take any of virtually a limitless number of different forms. Exemplary forms thereof are shown in FIGS. 11–16, which are not intended to be inclusive of all forms contemplated.

In FIGS. 11 and 12, one form of the connector elements 108, 110, 112 is shown to include a conductive arm 136 with an offset 138 that curves to an upturned end 139. The offset 138 has a plurality of independently movable, discrete fingers 140 which are designed to engage the connector elements 80, 82, 84 in operation. Alternatively, the offset end could have a single "finger" as shown in dotted lines. The arm 136 is conventionally connected to the board 72, as by extending a connector (not shown) through a mounting hole 142.

In FIG. 13, a modified form of connector element 108', 110', 112' is shown having a conductive arm 144. The arm 144 is formed from braided wire and has a contact end 146 which is fibrillated to define a plurality of "bristles" 148, which are independently flexible and contactable with the connector elements 80, 82, 84. The arm 144 can be attached in the same manner as the arm 136, utilizing a mounting hole 150.

In FIGS. 14 and 15, a further modified form of connector element 108", 110", 112" is shown with separate arms 150, 152 projecting away from a mounting portion 154 including a mounting hole 156. The arms 150, 152 have the same construction as the arm 136 shown in FIG. 11, including the fingers 140', corresponding to the previously described fingers 140, which curve to upturned ends 139'.

In FIG. 16, a further modified form of connector element 108''', 110''', 112''' is disclosed corresponding to the construction shown in FIGS. 14 and 15, but utilizing a braided metal wire construction as described with respect to FIG. 13. Accordingly, separate arms 158, 160 are defined with fibrillated ends 162, 164 at which bristles 148' are formed.

In all embodiments, there can be a single finger, two or ore fingers, and/or "bristles" alone or on one or more fingers.

In all of the embodiments disclosed in FIGS. 11–16, the conductive material can be used alone or coated as by dipping in molten conductive material such as gold, silver, tin, lead, etc. to improve conductivity. Additionally, a lubricant can be used to improve the integrity and conductivity of the connection between the connector elements 80, 82, 84 and 108, 110, 112, including variations of the latter shown in FIGS. 11–16.

Figure 17:
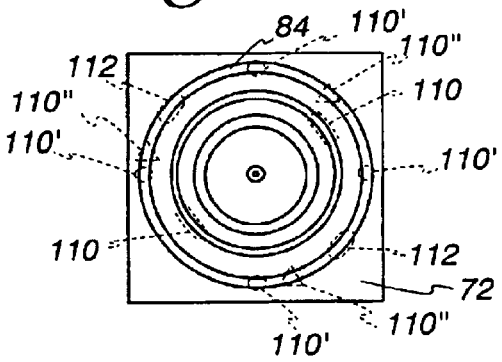
FIG. 17 is a view as in FIG. 7 and showing one cooperative arrangement of connector elements on the separate connector assemblies.

To avoid skewing of the boards 68, 72 from their desired relationship, the connector elements 108, 110, 112 can be modified as shown in FIG. 17. More specifically, two or more of the connector elements 112 may be provided on the board 72 to cooperate with the connector element 84 at evenly spaced, diametrically opposite locations to balance forces acting between the boarding 68, 72. In FIG. 17, the use of two of the connector elements 110 in a like diametrically opposite relationship is also disclosed. Two of the connector elements 108 could likewise be utilized.

One alternative arrangement for the connector elements 110 is depicted in FIG. 17 with the connector elements 110' shown as circles at four equally angularly spaced locations. In another form, connector elements 110" are shown as triangles at three equally angularly spaced locations. Other numbers and arrangements of each of the connector elements 108, 110, 112 are contemplated.

Figure 27:
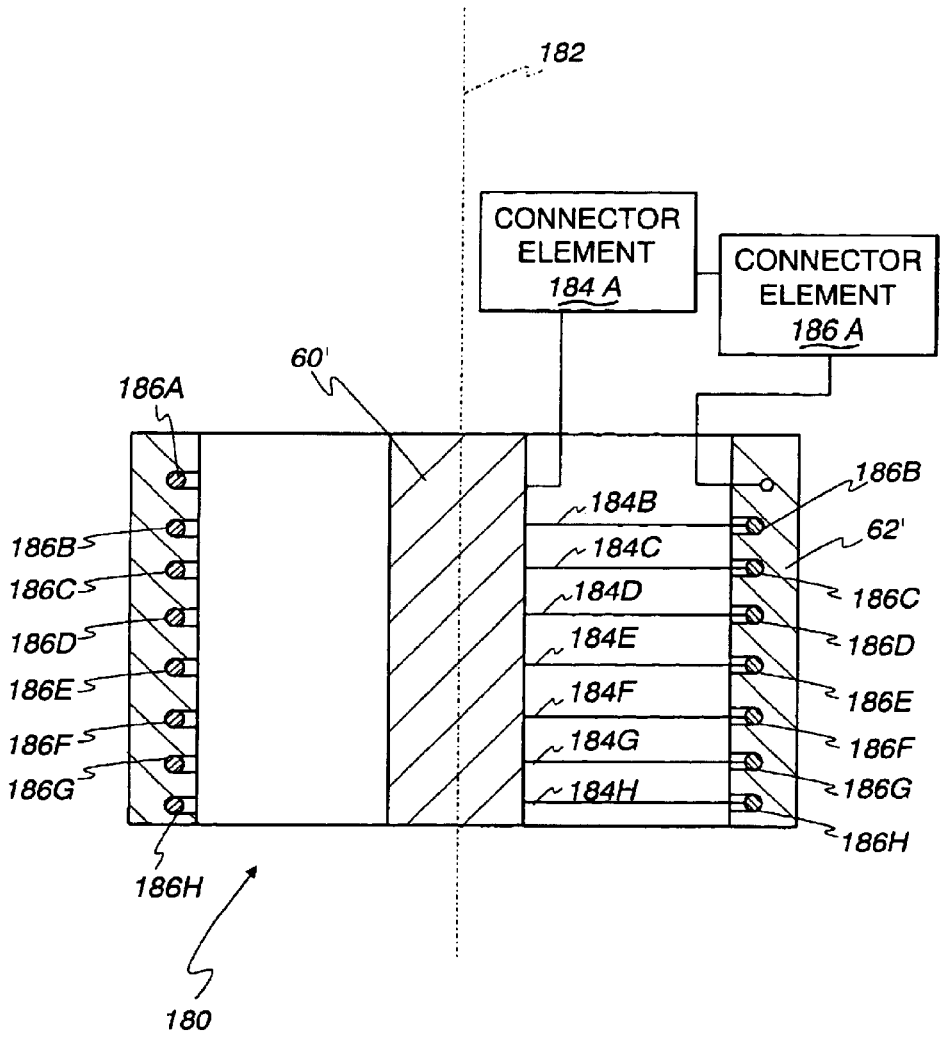
FIG. 27 is a partially schematic, cross-sectional, side elevation view of a cylindrical partially schematic, cross-sectional, commutator that can be used to electrically connect between discrete components of the system that pivot/rotate, one relative to the other.

In FIG. 27, a cylindrical commutator is shown at 180 consisting of cooperating first and second electrical connecting assemblies 60', 62'. The connecting assemblies 60', 62' are rotatable, one relative to the other, around an axis 182 and correspond in function to the connector assemblies 60, 62, previously described. In one form, the connector assembly 60' has eight connector elements 184A, 184B, 184C, 184D, 184E, 184F, 184G, 184H, which cooperate with a like number of connector elements 186A, 186B, 186C, 186D, 186E, 186F, 186G, 186H on the connector assembly 62'. Again, the precise number of connector elements will be dictated by the required system functions and features. In this embodiment, the connector element 62' is fixed, with the connector element 60' rotatable relative thereto around the axis 182. This arrangement could be reversed however. The connector elements 184A–184H and 186A–186B may each extend continuously around the axis 182 on their respective connector assemblies 60', 62' at axially spaced locations to establish and maintain electrical connection between the connector elements 184A–184H, 186A–186H.

Alternatively, the connector elements 184A–184H, 186A–186H on one of the connector assemblies 60', 62' can be non-continuous around the axis 182. As one example, the connector elements 184A–184H might each be a discrete, elongate arm projecting radially with respect to the axis 182 and extending less than 180° therearound. The connector elements 186A–186H could be separate annular conductors which continuously engage, one each, with an arm as the connector assemblies 60', 62' are relatively repositioned around the axis 182.

Alternatively, the connector elements 184A–184H might each have an annular edge each to engage one or more discrete conductive, connector elements 186A–186H extending less than fully around the axis 182 on the connector element 62'. Other commutator configurations and arrangements known to those skilled in the art, or designable by those skilled in the art, are contemplated.

Figure 18:
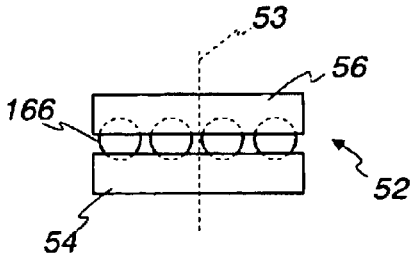
FIG. 18 is an elevation view of a bearing assembly used to guide relative rotational movement between the housing and a support therefor, as shown in FIG. 1.
Figure 19:
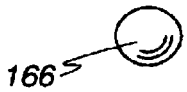
FIG. 19 is an elevation view of one form of bearing element used on the bearing assembly in FIG. 18.
Figure 20:
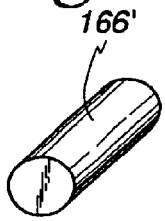
FIG. 20 is a perspective view of a modified form of bearing element used on the bearing assembly in FIG. 18.

Exemplary forms of the bearing assembly 52 are show in FIGS. 18–20. In FIG. 18, the bearing assembly 52 is shown with cooperating bearing portions 54, 56, which could be made from metal or plastic. Preferably, one or both of the bearing portions 54, 56 are made from a non-metallic material for purposes of cost, weight, and friction reduction. Bearing elements 166, as shown in FIGS. 18 and 19, act between the bearing portions 54, 56, to guide relative rotation therebetween around the axis 53. In this embodiment, the bearing elements 166 are shown in the form of metal spheres. The bearing elements 166 could also be non-metallic, and may be made, for example, from glass, ceramic, etc.

As an alternative, as shown in FIG. 20, the bearing elements could be in the form of cylindrical elements 166' which roll about their central axes as the bearing portions 54, 56 are moved, one relative to the other.

Virtually any other mechanism that guides relative rotational movement between elements could be incorporated into the invention as an alternative to the bearing assembly 52 shown.

Figure 21:
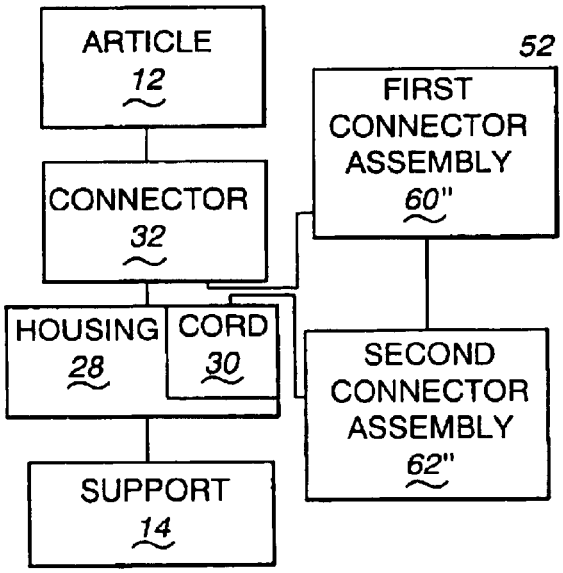
FIG. 21 is a schematic representation of a modified form of security system, according to the present invention, wherein cooperating first and second connecting assemblies are provided on the cord between the housing and the flexible cord connector.

As shown in FIG. 21, the invention also contemplates that corresponding first and second connector assemblies 60", 62" could be incorporated elsewhere than at the location shown in the FIG. 1 embodiment. As shown in FIG. 21, the first and second connector assemblies 60", 62" cooperate to define a conductive path for the conductive elements/wires 102, 104, 106 between discrete portions of the cord 30 at a location on the cord 30 between the housing 28 and the connector 32.

Figure 22:
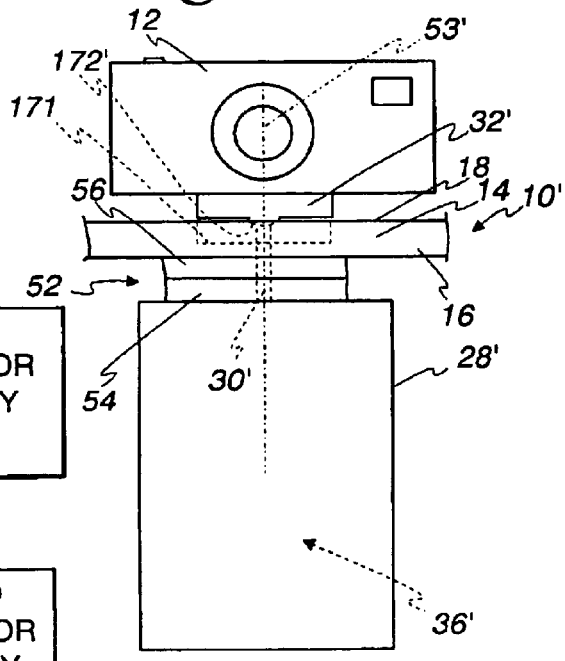
FIG. 22 is a view as in FIG. 1 of a modified form of security system, according to the invention, that differs by reason of not incorporating an alarm assembly.
Figure 23:
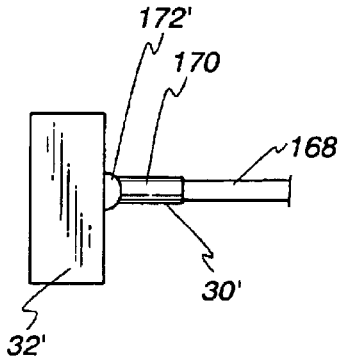
FIG. 23 is a fragmentary, elevation view of the connector on the end of the cable on the security system in FIG. 22.

As seen in FIGS. 22 and 23, the invention can also be practiced using purely mechanical components, as shown for the security system at 10'. The housing 28', corresponding to the housing 28, has a recoil mechanism 36' for a cord 30' at the end of which a connector 32' is attached. The housing 28' and recoil mechanism 36' may be made as described in U.S. Pat. No. 5,246,183, which is incorporated herein by reference. The connector 32' may be adhesively connected, as disclosed in that patent, or connected by utilizing an arrangement as shown in U.S. Pat. No. Des. 335,439, also incorporated herein by reference. The cord 30' may be made as from a braided metal wire 168 with or without a surrounding sheath/layer 170.

The housing 36' may be attached to the wall/layer 16 on the support 14 utilizing the aforementioned bearing assembly 52, with the first bearing portion 54 attached directly to the housing 28' and the second bearing portion 56 attached to the wall/layer 16, as previously described.

The security system 10' operates in the same manner as the security system 10, without the incorporation of the alarm assembly 38. Each time the user picks up and pivots the article 12, a rotative force is imparted through the connector 32' to the cord 30', which in turn causes the housing 28', carrying the wrapped supply of the cord 30', to pivot around the axis 53'. Accordingly, the twisting force is not allowed to cumulatively be applied to the cord 30' as might ultimately cause the cord 30' to detrimentally shorten in length or, in a worst case kink, so as to impair operation of the recoil mechanism 36'.

The security system 10' also differs by reason of the fact that there is no corresponding tube 22 to support the article 12. Instead, the connector 32' bears directly against the side 18 of the wall/layer 16 with the cord 30' retracted. The thickness of the connector 32' produces a slight spacing between the article 12 and the wall/layer 16 to facilitate grasping of the article 12 by a user.

Alternatively, a recess 171 (FIG. 22) may be provided in the wall/layer 16 to accommodate the connector 32' for flush mounting of the article 12.

The connector 32 has a curved protrusion 172, as seen in FIGS. 3–5, with the connector 32' having a like protrusion 172'. The protrusions 172, 172' may be utilized to maintain a slight spacing between the connectors 32, 32' and a cooperating surface against which they are drawn as the cords 30, 30' are retracted. Also the curved configuration of the projection 172, 172' allows the connectors 32, 32' to pivot slightly relative to the cooperating surface against which they are drawn. This may facilitate handling of the article 12 by a potential consumer.

Figure 24:
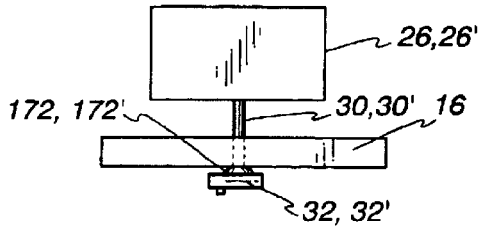
FIG. 24 is a schematic representation showing one relationship between the housing, cord, and connector and support, with the support including a horizontally extending wall/layer, according to the present invention.
Figure 25:
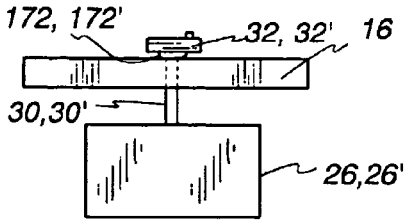
FIG. 25 is a view as in FIG. 24 of a modified form of the system shown in FIG. 24, with the horizontally extending wall/layer.
Figure 26:
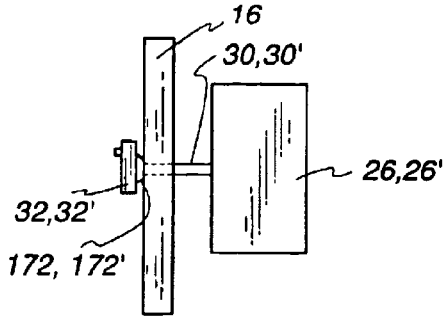
FIG. 26 is a view as in FIGS. 24 and 25 of the system integral with a vertically extending wall/layer.

As shown in FIGS. 24–26, the housings 26, 26' may be mounted in different relationships with the wall/layer 16. In FIG. 24, the housing 26, 26' is mounted above the layer 16 so that the cord 30, 30' projects downwardly through the wall/layer 16 to the connector 32, 32'.

In FIG. 25, the vertical arrangement of the components in FIG. 24 is reversed, so that the housing 26, 26' is beneath the wall/layer 16.

In FIG. 26, the housing 26, 26' is shown in relationship to a vertically extending wall/layer 16.

the cord 30 may terminate in a modular phone plug 175, as shown in FIG. 1, to facilitate connection and disconnection of components.

Other configurations for the connector 32 are contemplated, such as lasso arrangements, etc.

The foregoing disclosure of specific embodiments is intended to be illustrative of the broad concepts comprehended by the invention.

What is claimed is:

1. A security system comprising:

a flexible cord having a length;

a housing mountable in an operative position to a support and into which the cord is urged into a stored state and from which the cord can be selectively withdrawn; and a connector on the cord, the connector attachable to an article to be monitored, at least one of a) a first discrete part of the cord being repositionable relative to a second discrete part of the cord and b) at least a part of the housing being repositionable relative to a support upon which the housing is mounted in an operative position to control twisting of the cord about the length of the cord by reason of turning of the connector.

2. The security system according to claim 1 wherein the first discrete part of the cord has a first connector assembly and the second discrete part of the cord has a second connector assembly, and at least a part of the first connector assembly is movable guidingly relative to at least a part of the second connector assembly.

3. The security system according to claim 2 wherein the cord comprises at least a first conductive element, the first connector assembly has a first connector element, the second connector assembly has a second connector element, and the first and second connector assemblies define a conductive path for the at least first conductive element between the first and second discrete cord parts.

4. The security system according to claim 3 wherein the first connector element is movable guidingly relative to the second connector element around an axis.

5. The security system according to claim 4 wherein the first connector element is movable against the second connector element as the at least part of the first connector assembly is moved guidingly relative to the at least part of the second connector assembly.

6. The security system according to claim 3 wherein the first connector element is movable against the second connector element as the at least part of the first connector assembly is moved guidingly relative to the at least part of the second connector assembly.

7. The security system according to claim 4 wherein the first connector element comprises an arcuate conductor and the second connector element comprises at least a first conductive arm which contacts the arcuate conductor.

8. The security system according to claim 7 wherein the first conductive arm comprises a plurality of discrete fingers which contact the arcuate conductor.

9. The security system according to claim 7 wherein the second connector element comprises a second arm which contacts the arcuate conductor, the first and second arms contacting the arcuate conductor at spaced locations.

10. The security system according to claim 3 further in combination with an alarm assembly capable of generating a detectable signal in the event that the conductive path is interrupted.

11. The security system according to claim 10 wherein the connector has an armed state when attached to an article to be monitored and an alarm state with the connector detached from an article to be monitored, and the alarm system generates the detectable signal as an incident of the connector being detached and changing from the armed state into the alarm state.

12. The security system according to claim 1 further in combination with an article to which the connector is attached.

13. The security system according to claim 1 further in combination with a support to which the housing is mounted in the operative position.

14. The security system according to claim 13 further comprising a layer associated with the support and having first and second opposite sides, the housing is on the first side of the layer, and the cord extends through the layer so that the connector is on the second side of the layer.

15. The security system according to claim 13 wherein the security system comprises a bearing assembly which acts between the housing and the support to guide repositioning of the housing relative to the support.

16. The security system according to claim 15 wherein the bearing assembly comprises a first bearing portion that moves as one piece with the housing, a second bearing portion on the support and a plurality of bearing elements that act between the first and second bearing portions.

17. The security system according to claim 16 wherein each of the plurality of bearing elements comprises a roller element.

18. The security system according to claim 17 wherein the first and second bearing portions comprise a non-metal material and the plurality of bearing elements comprise a metal material.

19. The security system according to claim 16 wherein each of the roller elements comprises a sphere.

20. The security system according to claim 16 wherein the security system comprises a support bracket to which the housing is mounted so that the support bracket moves as one piece with the housing.

21. A security system comprising:

a flexible cord having a length;

a housing mountable in an operative position to a support and into which the cord is urged into a stored state and from which the cord can be selectively withdrawn; and a connector on the cable, the connector attachable to an article to be monitored, at least one of a) a first discrete part of the cord being repositionable relative to a second discrete part of the cord and b) at least a part of the housing being repositionable relative to a support upon which the housing is mounted in an operative position to control twisting of the cord about the length of the cord by reason of turning of the connector, wherein the first discrete part of the cord has a first connector assembly and the second discrete part of the cord has a second connector assembly, and at least a part of the first connector assembly is movable guidingly relative to at least a part of the second connector assembly, wherein the cord comprises at least a first conductive element, the first connector assembly has a first connector element, the second connector assembly has a second connector element, and the first and second connector assemblies define a conductive path for the at least first conductive element between the first and second discrete cord parts, wherein the first connector element is movable guidingly relative to the second connector element around an axis, wherein the first connector element is movable guidingly relative to the second connector element continuously in one direction around the axis without causing kinking of the cord.

22. A security system comprising:

a flexible cord having a length;

a housing into which the cord is urged into a stored state and from which the cord can be selectively withdrawn;

a support to which the housing is mounted in an operative position; and an article to which the cord is attached, the flexible cord, housing, and support being interconnected so that the cord can be turned about the length of the cord continuously in one direction by turning the article to which the cord is attached without causing kinking of the cord.

23. The security system according to claim 22 further comprising a layer associated with the support and having first and second opposite sides, the housing is on the first side of the layer, and the cord extends through the layer so that the connector is on the second side of the layer.

24. A security system comprising:

a flexible cord having a length;

a housing into which the cord is urged into a stored state and from which the cord can be selectively withdrawn;

a support to which the housing is mounted in an operative position; and an article to which the cord is attached, the flexible cord, housing, and support being interconnected so that the cord can be turned about the length of the cord continuously in one direction without causing kinking of the cord, wherein the flexible cord has first and second discrete parts, the first discrete part of the cord has a first connector assembly, the second discrete part of the cord has a second connector assembly, and at least a part of the first connector assembly is movable guidingly relative to at least a part of the second connector assembly.

25. The security system according to claim 24 wherein the cord comprises at least a first conductive element, the first connector assembly has a first connector element, the second connector assembly has a second connector element, and the first and second connector assemblies define a conductive path for the at least first conductive element between the first and second discrete cord parts.

26. The security system according to claim 25 wherein the first connector element is movable guidingly relative to the second connector element around an axis.

27. The security system according to claim 25 further in combination with an alarm assembly capable of generating a detectable signal in the event that the conductive path is interrupted.

28. A security system comprising:

a flexible cord having a length;

a housing into which the cord is urged into a stored state and from which the cord can be selectively withdrawn;

a support to which the housing is mounted in an operative position; and an article to which the cord is attached, the flexible cord, housing, and support being interconnected so that the cord can be turned about the length of the cord continuously in one direction without causing kinking of the cord, wherein the security system comprises a bearing assembly which acts between the housing and the support to guide repositioning of the housing relative to the support.

29. The security system according to claim 28 wherein the bearing assembly comprises a first bearing portion that moves as one piece with the housing, a second bearing portion on the support, and a plurality of bearing elements that act between the first and second bearing portions.

* * * * *